US006581926B2

(12) United States Patent
Hsiao et al.

(10) Patent No.: US 6,581,926 B2
(45) Date of Patent: Jun. 24, 2003

(54) STRUCTURE FOR FIXING ROLLER

(75) Inventors: Sidney Hsiao, Changhua (TW); Jones Wu, Yunghe (TW); Jackly Liu, Taichung (TW); Julian Liu, Banchiau (TW)

(73) Assignee: Silitek Corporation (TW)

( * ) Notice: Subject to any disclaimer, the term of this patent is extended or adjusted under 35 U.S.C. 154(b) by 90 days.

(21) Appl. No.: 09/846,558

(22) Filed: Apr. 26, 2001

(65) Prior Publication Data

US 2002/0158408 A1 Oct. 31, 2002

(51) Int. Cl.[7] ..... B65H 1/00
(52) U.S. Cl. ..... 271/171
(58) Field of Search ..... 271/171; 74/29, 74/31, 34, 422

(56) References Cited

U.S. PATENT DOCUMENTS 5,805,308 A * 9/1998 Tanaka et al. ..... 271/171

FOREIGN PATENT DOCUMENTS

JP 4-45018 * 2/1992 ..... 271/171
JP 10-140926 * 5/1998 ..... 271/171

* cited by examiner

*Primary Examiner*—Christopher P. Ellis
*Assistant Examiner*—Mark A. Deuble
(74) *Attorney, Agent, or Firm*—Peter F. Corless; Steven M. Jensen; Edwards & Angell, LLP

(57) ABSTRACT

A structure for fixing a roller on a base is disclosed. The structure includes a sheet-like elastomer having a guiding hole for trapping a shaft of the roller, and two fixing elements respectively disposed at two opposite sides of the base, which is located at two lateral sides of the roller, for receiving two ends of the sheet-like elastomer to provide a deformation of the sheet-like elastomer for providing a suppress power for the roller.

6 Claims, 4 Drawing Sheets

STRUCTURE FOR FIXING ROLLER

FIELD OF THE INVENTION

The present invention relates to a structure for fixing a roller, and more particularly to a structure for fixing a roller on a base.

BACKGROUND OF THE INVENTION

An automatic document feeder (ADF) is essential for an office machine such as fax machine, copy machine, printer or scanner. The automatic document feeder is used to feed papers one by one into the machine for printing, copying, scanning or faxing.

Generally, the automatic document feeder includes an adjustment device for adjusting the width of a guiding paper tray. FIG. 1A is a diagram illustrating a structure of an adjustment device for adjusting the width of a guiding paper tray in an automatic document feeder according to the prior art. The adjustment device includes two stoppers 11, 12 that can be adjusted by sliding to change the width of the guiding paper tray according to the paper size. FIG. 1B is a diagram illustrating a bottom structure of FIG. 1A. The bottoms of the stoppers 11, 12 are connected to racks 13, 14, respectively, driven by a gear 15 to move the stoppers 11, 12 for achieving the width adjustment effect. As shown in FIG. 1B, the gear 15 is fixed on a base via a screw 151. Therefore, the assembling procedure is time-consuming and labor intensive. In addition, the material is cost.

Therefore, the purpose of the present invention is to develop a structure for fixing a roller to deal with the above situations encountered in the prior art.

SUMMARY OF THE INVENTION

It is therefore an object of the present invention to propose a structure for fixing a roller on a base for simplifying an assembling procedure.

It is therefore another object of the present invention to propose a structure for fixing a roller on a base for reducing labor-consumption.

It is therefore an additional object of the present invention to propose a structure for fixing a roller on a base for reducing the material cost.

According to the present invention, there is proposed a structure for fixing a roller on a base. The structure includes a sheet-like elastomer having a guiding hole for trapping a shaft of the roller, and two fixing elements respectively disposed at two opposite sides of the base, which is located at two lateral sides of the roller, for receiving two ends of the sheet-like elastomer to provide a deformation of the sheet-like elastomer for providing a suppress power for the roller.

Preferably, the two fixing elements are two fixing grooves. Preferably, the sheet-like elastomer further includes a first jut for positioning the elastomer. Certainly, the sheet-like elastomer additionally can include a second jut to provide a handling position for assembler when the two ends of the sheet-like elastomer are put in the two fixing grooves. Preferably, the first jut and the second jut are disposed at two opposite sides of the guiding hole.

Preferably, the sheet-like elastomer is made of metal.

Preferably, the roller is a gear movably connected onto two racks slid on the base.

According to the present invention, there is proposed a width adjustment device for using to adjust the width of a guiding paper tray. The device includes a base for putting papers thereon, two stoppers disposed at two opposite sides of the base, two racks respectively connected to the two stoppers and slid on the base, a gear simultaneously connected to the two racks and driven thereby to carry the two stoppers to change the width, a sheet-like elastomer having a guiding hole for trapping a shaft of the gear, and two fixing elements respectively disposed at two opposite sides of the base, which is located at two lateral sides of the gear, for receiving two end of the sheet-like elastomer to provide a deformation of the sheet-like elastomer for providing a suppress power for the gear.

Preferably, the two fixing elements are two fixing grooves. Preferably, the sheet-like elastomer further includes a first jut for positioning the elastomer. The sheet-like elastomer additionally includes a second jut to provide a handling position for assembler when the two ends of the sheet-like elastomer are put in the two fixing grooves. The first jut and the second jut are preferably disposed at two opposite sides of the guiding hole.

Preferably, the sheet-like elastomer is made of metal.

The present invention may best be understood through the following description with reference to the accompanying drawings, in which:

DETAILED DESCRIPTION OF THE PREFERRED EMBODIMENTS

Figure 1A:
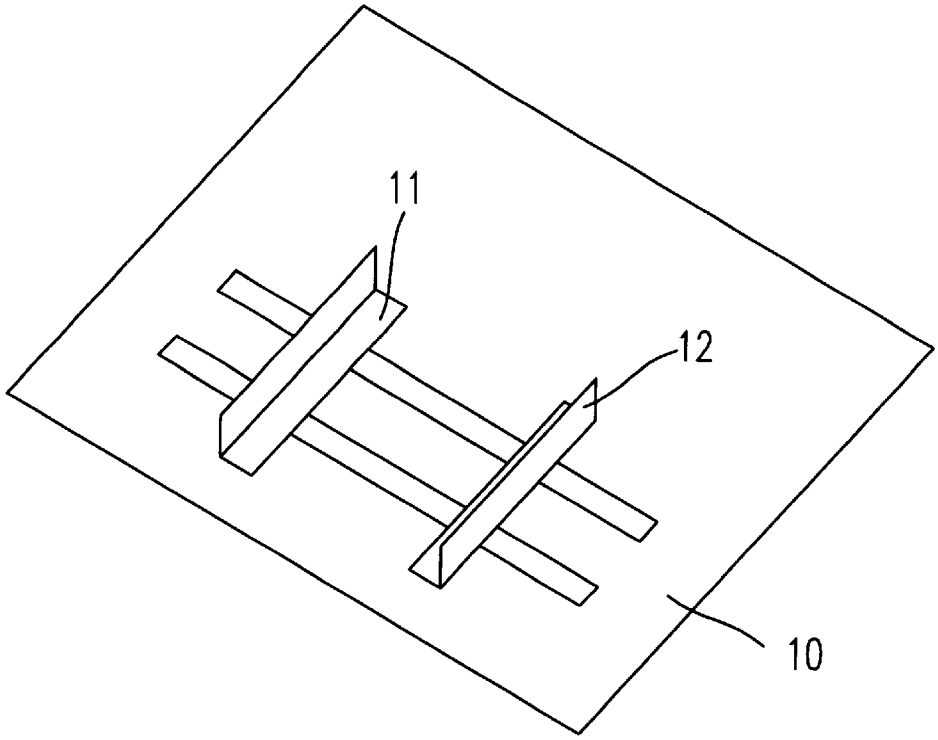
Fig. 1A PRIOR ART
FIG. 1A is a diagram illustrating a structure of an adjustment device for adjusting the width of a guiding paper tray in an automatic document feeder (ADF) according to the prior art.
Figure 1B:
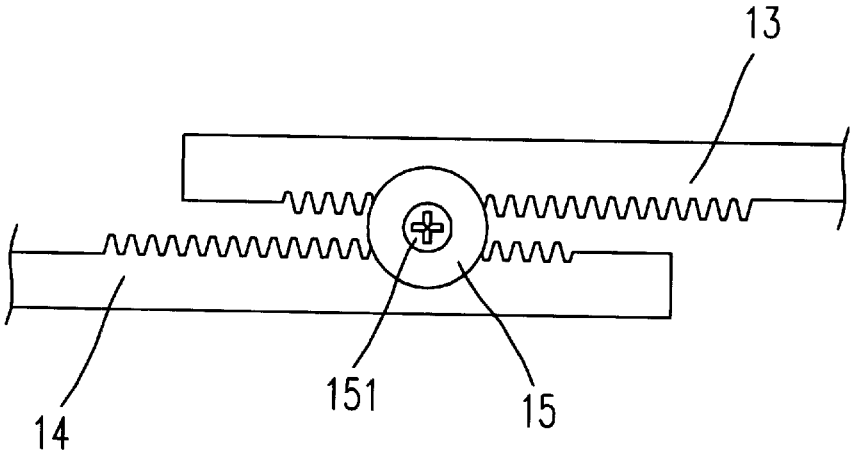
Fig. 1B PRIOR ART
FIG. 1B is a diagram illustrating a bottom structure of FIG. 1A.
Figure 2:
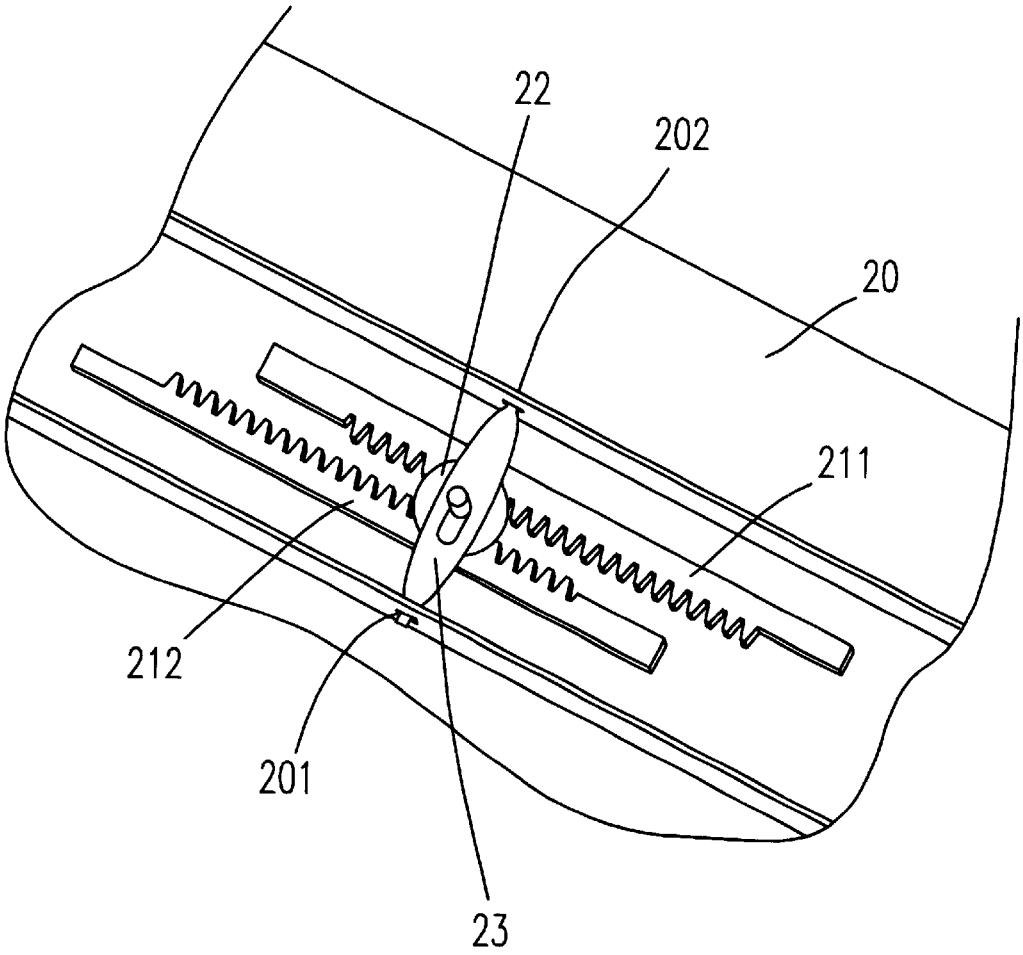
FIG. 2 is a diagram illustrating a structure for fixing a roller in a an adjustment device for adjusting the width of a guiding paper tray according to a preferred embodiment of the present invention.

FIG. 2 is a diagram illustrating a structure for fixing a roller in an adjustment device for adjusting the width of a guiding paper tray according to a preferred embodiment of the present invention. The adjustment device includes a base 20, two stoppers (not shown), two racks 211, 212, and a roller, e.g. a gear 22, as shown in FIG. 2. The operation principle of the adjustment device according to the present invention is similar to that of the prior art, which is not required to repeatedly mention. The present invention is characterized in that the structure for fixing a roller on the base 20 includes a sheet-like elastomer 23 and two fixing elements, e.g. two fixing grooves 201, 202.

Figure 3:
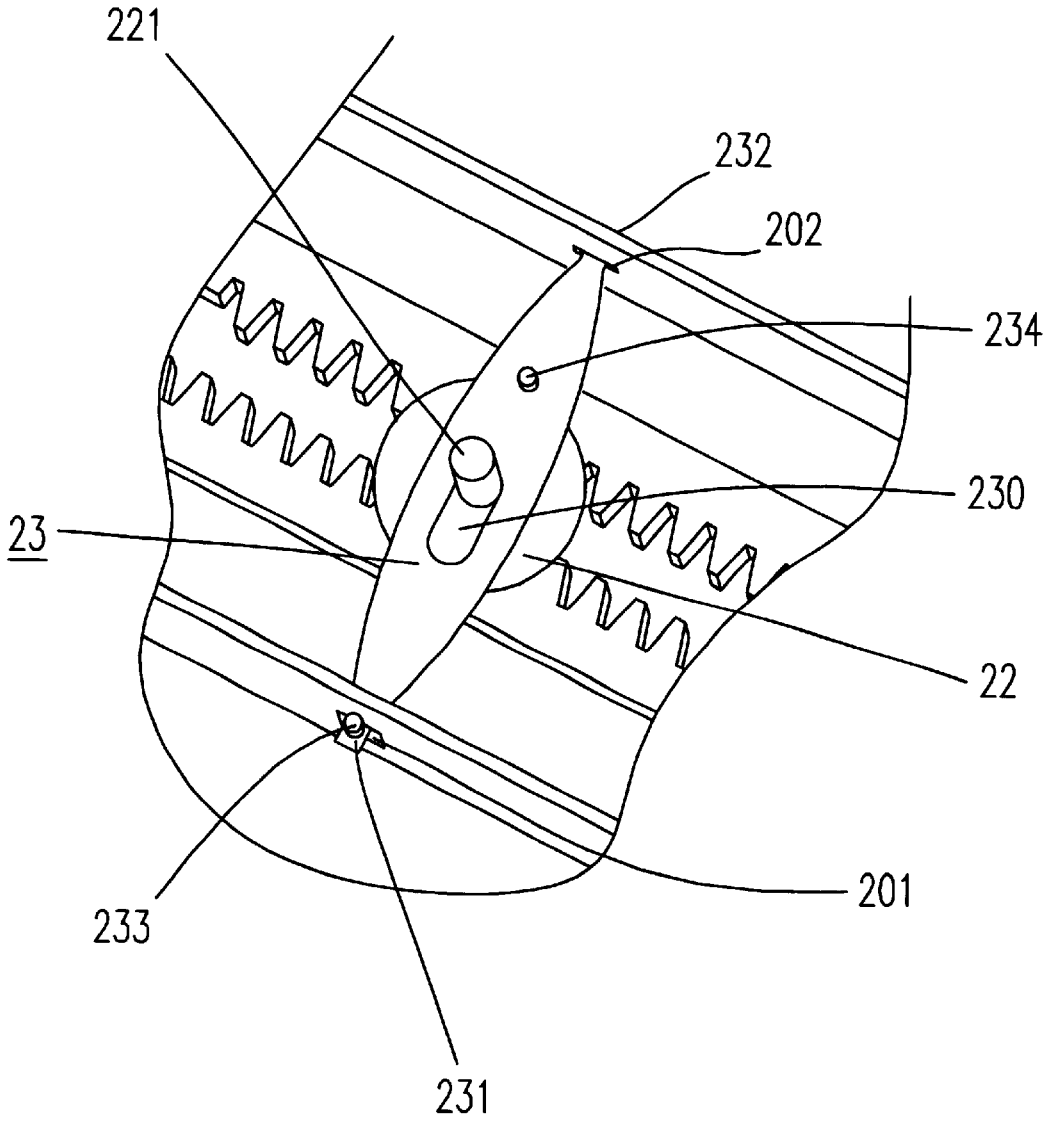
FIG. 3 is a enlarged diagram illustrating the detail structure for fixing the roller which includes a sheet-like elastomer and two fixing grooves according to the preferred embodiment in FIG. 2.

FIG. 3 is an enlarged diagram of the sheet-like elastomer 23 and two fixing grooves 201, 202 in FIG. 2. As shown in FIG. 3, the sheet-like elastomer 23 has a guiding hole 230 for trapping a shaft 221 of the gear 22 thereon. The two fixing grooves 201, 202 are disposed in opposite sides of the base, which is located at two lateral sides of the gear 22, to occur a deformation of the sheet-like elastomer 23 for providing a suppress power for the gear 22.

Figure 4A:
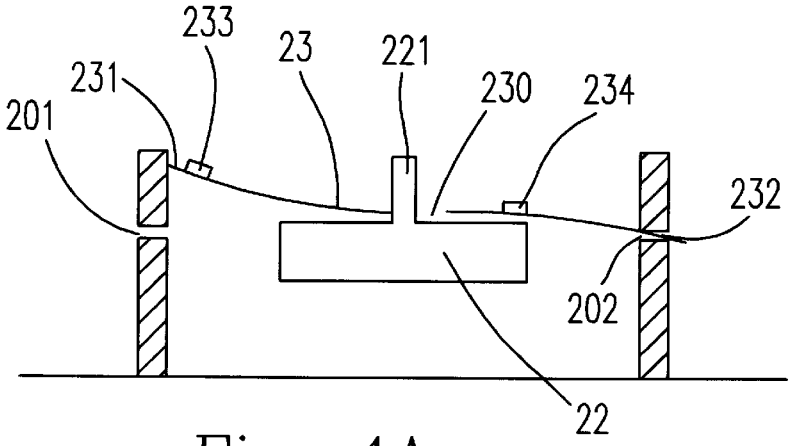
FIGS. 4A–4C are diagrams illustrating assembling steps of a structure for fixing a roller in an adjustment device for adjusting the width of a guiding paper tray according to a preferred embodiment of the present invention.
Figure 4B:
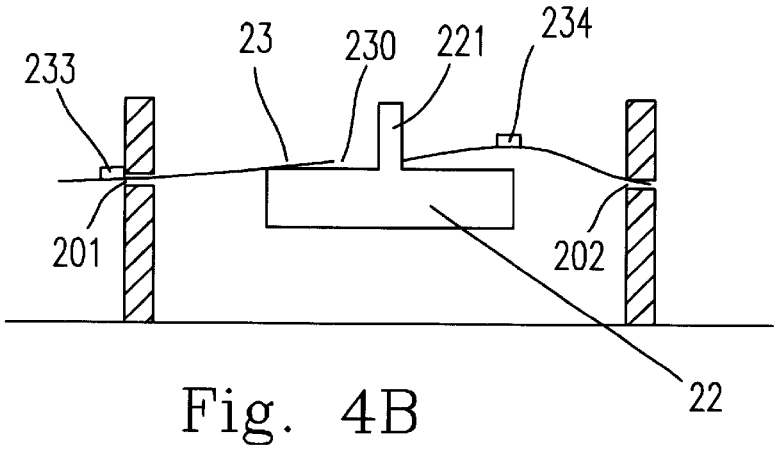
Figure 4C:
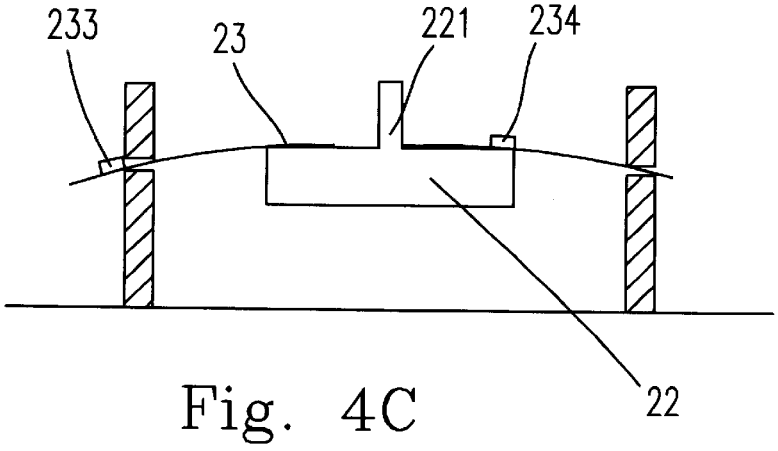

For easily assembling, the sheet-like elastomer 23 includes a first jut 233 and a second jut 234, and the guiding hole 230 is a long-and-narrow shape. FIGS. 4A–4C are diagrams illustrating the assembling steps. After the guiding hole 230 of the sheet-like elastomer 23 is trapped on the shaft 221 of the gear 22, and the end 232 of the sheet-like elastomer 23 is inserted into the fixing groove 202 as shown in FIG. 4A, the assembler pushes down the end 231 of the sheet-like elastomer 23 and uses the second jut 234 as a handling point for putting the end 231 of the sheet-like elastomer 23 into the fixing groove 201 as shown in FIG. 4B. The guiding hole 230 is provided with a space for sliding because its long-and narrow shape. Thus, the first jut 233 is against the outside edge of the fixing groove 202 as shown in FIG. 4C for finishing the position of the sheet-like elastomer 23. The sheet-like elastomer 23 is made of metal or elastic materials. In addition, the shape of the jut can be a cylinder for providing a slight resistance when positioning, handling, and pushing.

In sum, the structure for fixing a roller according to the present invention provides an easy way to assemble and an even suppress power for the roller to cause the coordinative actions between the rack and the gear in the guiding paper tray.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A width adjustment device for adjusting the width of a guiding paper tray, comprising:

a base for putting papers thereon:

two stoppers disposed at two opposite sides of said base;

two racks respectively connected to said two stoppers and slid on said base;

a gear simultaneously connected to said two racks and driven thereby to carry said two stoppers to change said width;

a sheet-like elastomer having a guiding hole for trapping a shaft of said gear; and two fixing elements respectively disposed at opposite lateral sides of said gear, for receiving two ends of said sheet-like elastomer to provide a deformation of said sheet-like elastomer for pressing said gear.

2. The device according to claim 1, wherein said two fixing elements are two fixing grooves.

3. The device according to claim 2, wherein said sheet-like elastomer further comprises a first jut for positioning said elastomer.

4. The device according to claim 3, wherein said sheet-like elastomer further comprises a second jut to provide a handling position for assembly when said two ends of said sheet-like elastomer are put in said two fixing grooves.

5. The device according to claim 4, wherein said first jut and said second jut are disposed at two opposite sides of said guiding hole.

6. The device according to claim 1, wherein said sheet-like elastomer is made of metal.

* * * * *